US006206817B1

(12) United States Patent
Sette et al.

(10) Patent No.: US 6,206,817 B1
(45) Date of Patent: Mar. 27, 2001

(54) METHOD AND APPARATUS FOR FOLDING SHEETS

(75) Inventors: Paul R. Sette, Branford; Richard A. Sloan, Jr., Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/442,551

(22) Filed: Nov. 18, 1999

(51) Int. Cl.[7] ..... B31F 1/08

(52) U.S. Cl. ..... 493/421; 493/23; 493/405; 493/420; 493/435; 493/442; 493/460; 271/184

(58) Field of Search ..... 493/419, 420, 493/405, 478, 23, 434, 442, 435, 460; 271/184

(56) References Cited

U.S. PATENT DOCUMENTS

| | | | | |
|---|---|---|---|---|
| 1,813,476 | * | 7/1931 | Waterworth | 493/419 |
| 5,192,389 | * | 3/1993 | Martin | 493/421 |
| 5,196,083 | * | 3/1993 | Baker et al. | 493/420 |
| 5,441,244 | * | 8/1995 | Bartose et al. | 493/420 |
| 5,514,066 | * | 5/1996 | Monaco | 493/25 |
| 5,520,603 | * | 5/1996 | Bluthardt et al. | 493/421 |
| 5,769,774 | * | 6/1998 | Beck et al. | 493/421 |
| 5,802,808 | | 9/1998 | Lyga | 53/381.5 |
| 5,813,327 | | 8/1998 | Freeman et al. | 101/93 |
| 5,816,570 | | 10/1998 | Paradis et al. | 271/179 |
| 5,818,724 | | 10/1998 | Brewster, Jr. et al. | 364/478.08 |

* cited by examiner

*Primary Examiner*—Peter Vo
*Assistant Examiner*—Hemant M Desai
(74) *Attorney, Agent, or Firm*—Michael E. Melton; Paul A. Levitsky

(57) ABSTRACT

A method and system for folding a sheet having a certain length into a folded piece of a fold type having a first edge and a second edge, wherein the sheet length and the fold type are simultaneously selectable. The sheet can be folded once or twice into the folded piece. After the sheet is folded into the folded piece, the folded piece moves in a direction with a first edge leading the second edge. The method and system further include a step and a mechanism to control the moving direction of the folded piece such that the folded piece can be caused to move with the first edge trailing the second edge or allowed to continue to move with the first edge leading the second edge when the folded piece exits the system.

15 Claims, 13 Drawing Sheets

METHOD AND APPARATUS FOR FOLDING SHEETS

CROSS-REFERENCE TO RELATED APPLICATIONS

Reference is made to application Ser. No. 09/442,559, entitled METHOD AND SYSTEM FOR DIRECTING AN ITEM THROUGH THE FEED PATH OF A FOLDING APPARATUS, assigned to the assignee of this application and filed on the even date herewith.

Reference is made to application Ser. No. 09,442,552, entitled METHOD AND SYSTEM FOR TABBING FOLDED MATERIAL, assigned to the assignee of this application and filed on the even date herewith.

Reference is made to application Ser. No. 09,442,561, entitled METHOD AND SYSTEM FOR FOLDING AND TABBING SHEETS, assigned to the assignee of this application and filed on the even date herewith.

TECHNICAL FIELD

The present invention is generally related to a folding apparatus for folding a sheet of a document into a folded piece and, in particular, to a folding apparatus wherein the folded piece can be directed to an envelope inserting machine to be inserted into an envelope, or to a tabbing apparatus to be sealed and used as a self-mailer.

BACKGROUND OF THE INVENTION

A self-mailer is conventionally defined as a mailpiece without an envelope. The self-mailer usually contains one or more sheets of printed material, folded once or twice by a folding machine into a smaller piece for mailing. Typically, the folded piece has a folded end and an open end (see FIGS. 11–14). The open end is sealed with one or more tabs before the self-mailer is sent to the addressee.

Folding machines are well-known. For example, U.S. Pat. No. 4,701,233 (Beck et al.) discloses a method of folding a sheet by bulging a portion of the sheet and then folding the bulged portion through a roller nip. U.S. Pat. No. 4,875,965 (Marzullo) discloses a folding apparatus wherein a buckle chute is used for stopping a sheet, causing the sheet to enter a roller nip for folding. U.S. Pat. No. 4,944,131 (Gough) also discloses a folding apparatus having a buckle chute. With the above-identified folding machines, when the folded piece exits the folding apparatus, it travels in the direction of the fold. This means that the folded end is leading the open end. Folding machines are generally designed for folding enclosure material to be inserted into envelopes in an envelope inserting device. In this particular application, the traveling direction of the folded piece is not very important. But for tabbing purposes, it is desirable that the folded piece travels with the open end leading the folded end. Thus, while the traveling direction of the folded piece exiting a prior art folding machine is suitable for envelope insertion, it is not suitable for tabbing.

It is advantageous and desirable to provide a method and an apparatus for folding sheets wherein the leading edge of the folded piece exiting the folding apparatus can be selected. Furthermore, it is advantageous and desirable to provide a method and apparatus for folding sheets wherein the length of the sheet to be folded and the type of fold for the folded piece can be easily selected.

SUMMARY OF THE INVENTION

The first aspect of the present invention is to provide an apparatus for folding a sheet having a certain length into a folded piece of a fold type having a first edge and an opposing second edge, wherein the apparatus includes a selecting mechanism to select he sheet length and the fold type, and a path directing mechanism to allow the folded piece to exit the folding apparatus with the first edge trailing or leading the second edge.

Accordingly, the folding apparatus of the present invention has a plurality of settings for selecting different fold types and selecting different sizes of the sheet to be folded. The folding apparatus comprises: a folding station, a feeding mechanism to feed the sheet into the folding station in order to fold the sheet into a folded piece; a turn chute having an ingesting nip to ingest the folded piece into the turn chute with the first edge leading the second edge, and an exiting nip to move the ingested folded piece out of the turn chute with the second edge leading the first edge.

Preferably, the folding station comprises: a first buckle chute for receiving the sheet fed into the folding station and folding the fed sheet into a folded sheet, a second buckle chute, and a deflector gate operable at a first gate position and a second gate position, wherein when the deflector gate is operated at the first gate position, the deflector gate causes the folded sheet to be ingested into the turn chute directly from the first buckle chute, and when the deflector gate is operated at the second gate position, the deflector gate allows the folded sheet to enter the second buckle chute to be folded again into the folded piece.

Preferably, the turn chute also includes a direct exit, and a reversing stop operable at a first position and a second position, wherein when the reversing stop is operated at the first position, the reversing stop causes the ingested folded piece to be engaged with the exiting nip so as to allow the exiting nip to move the ingested folded piece out of the turn chute with the second edge leading the first edge; and when the reversing stop is operated at the second position, the ingested folded piece is allowed to exit through the direct exit with the first edge leading the second edge.

Preferably, the reversing stop in the turn chute is adjustable to suit the fold type and the sheet length; and the first buckle chute is adjustable to suit the fold type and the sheet length; and the folding apparatus further includes a selecting mechanism linking to the first buckle chute, the reversing stop in the turn chute and the deflector gate for simultaneously selecting the operating position of the deflector gate and adjusting the first buckle chute and the reversing stop in order to suit the fold type and the sheet length in accordance with the settings.

The second aspect of the present invention is to provide a method of folding a sheet having a certain length into a folded sheet of a fold type. The folding method comprises the steps of: providing the sheet to be folded; folding the sheet into a folded piece having a first edge and an opposing second edge, wherein the folded piece moves in a direction with the first edge leading the second edge after the sheet is folded; and controlling the moving direction of the folded piece so that the first edge leads or trails the second edge.

Preferably, the folding step is carried out in a buckle chute that makes a single fold and has a sheet stop for selecting the fold type and the sheet length, and the controlling step is carried out in a turn chute having a reversing stop adjustable to suit the fold type and the sheet length, wherein the sheet stop and the reversing stop are linked to a turn knob for simultaneously adjusting the reversing stop and sheet stop to suit the fold type and the sheet length.

Preferably, the folding step is further carried out in a second buckle chute for making a second fold if required.

It is also preferred that the turn chute has a direct exit and a reversing exit, and the reversing stop is operable at a first position to cause the folded piece to exit through the reversing exit with the second edge leading the first edge, and a second position to allow the folded piece to exit through the direct exit with the first edge leading the second edge.

The method and apparatus for folding a sheet into a folded piece, according to the present invention, will become apparent upon reading the description taken in conjunction with FIG. 1 to FIG. 14.

DETAILED DESCRIPTION

Figure 1:
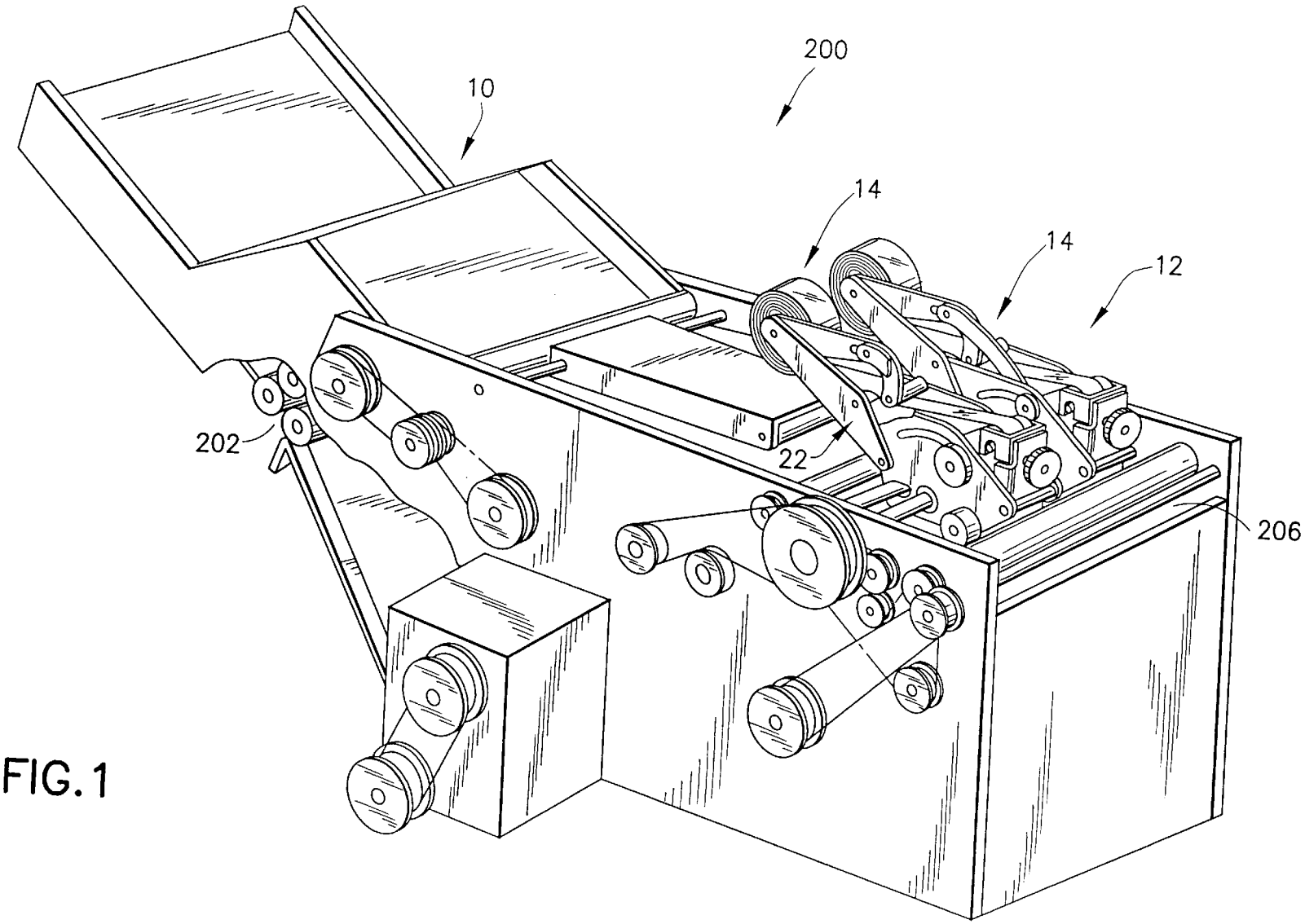
FIG. 1 is an isometric view of a self-mailer producing machine showing a folding apparatus and a tabbing apparatus.

FIG. 1 illustrates a typical self-mailer producing machine 200 which comprises a folding apparatus 10 and a tabbing apparatus 12. The folding apparatus 10 takes in a sheet of document 120 (see FIG. 2) at an entrance end 202 and folds the sheet into a folded piece 130 (see FIG. 2). The folded piece 130 is then moved to the tabbing apparatus 12 where a tab is put on the leading edge of the folded piece 130 to seal the folded piece 130 into a self-mailer 140 (see FIG. 2). The sealed folded piece, or the self-mailer 140, is moved out of the tabbing apparatus 12 at an exit end 206.

Figure 2:
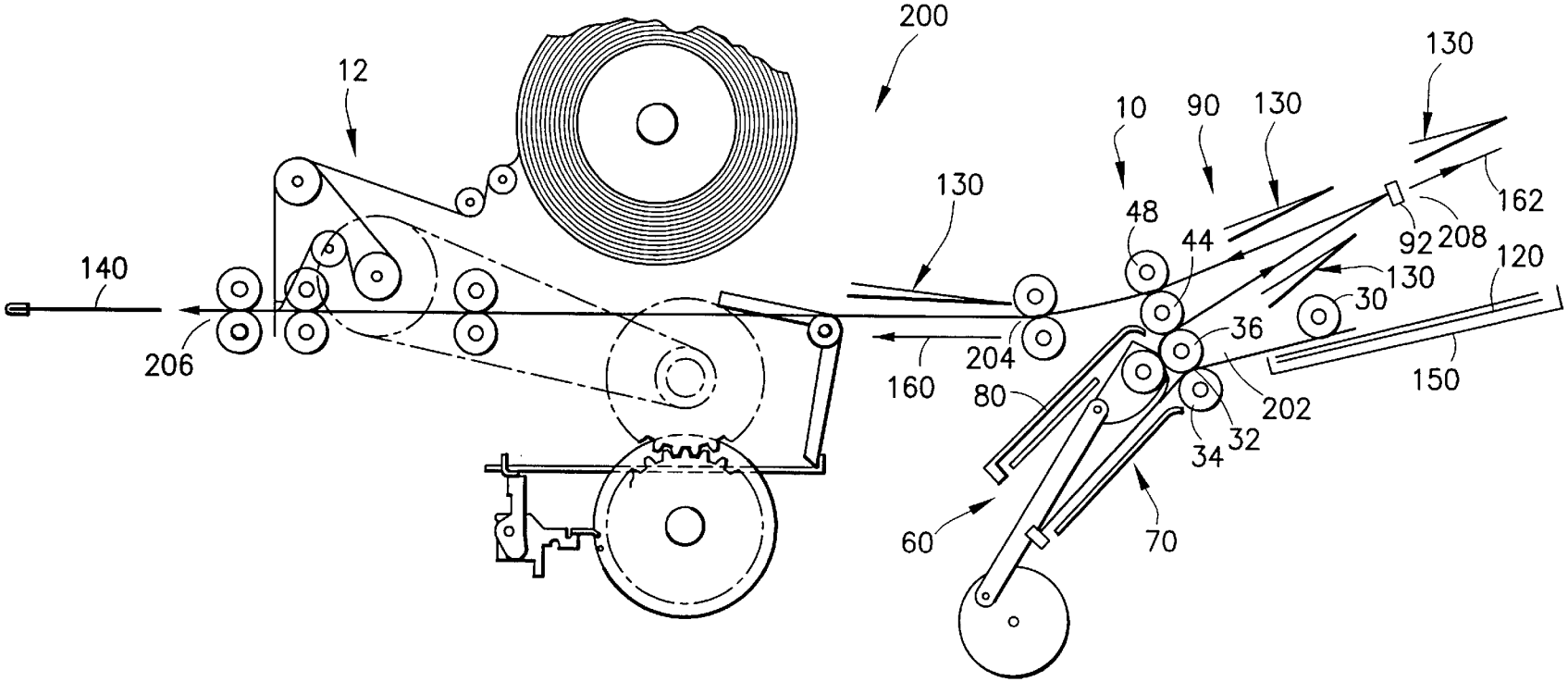
FIG. 2 is a schematic representation of a self-mailing producing machine showing the different paths for the folded piece to exit the folding apparatus, according to the present invention.

As shown in FIG. 2, the folding apparatus 10 has a feed roller 30 for picking up one sheet of document 120 at a time from a paper tray or cassette 150. The sheet of document 120 is moved into a folding station 60 through a nip 32 formed by rollers 34 and 36. After the sheet 120 is folded into a folded piece 130, it is ingested into a turn chute 90 by rollers 36 and 44. Inside the turn chute 90, a turn chute stop 92 is used to stop the ingested folded piece 130 and cause the folded piece 130 to be moved out of the turn chute 90 by rollers 44 and 48. After the folded piece 130 is moved out of an exit end 204 of the folding apparatus 10, it is moved towards the tabbing apparatus 12 along a moving path 160. After the folded piece 130 is sealed by the tabbing apparatus 12, it becomes a self-mailer 140 and is moved out of the tabbing apparatus 12 at the exit end 206.

As shown in FIG. 2, the folding station 60 includes a first buckle chute 70 and a second buckle chute 80. If the folded piece 130 is required to be folded only once, then only the first buckle chute 70 is used for folding the sheet 120. It is followed that the folded piece 130 is moved directly from the first buckle chute 70 into the turn chute 90. If the folded piece 130 is required to be folded twice, then the sheet 120 is folded once by the first buckle chute 70 and then moved into the second buckle chute 80 for the second fold before the folded piece 130 is ingested into the turn chute 90.

It is possible to move the folded piece 130 out of the folding apparatus 10 through another path 162 at the exit end 208 of the turn chute 90 by removing the turn chute stop 92 from the path of the ingested folded piece 130. In that case, the folded piece 130 can be directed towards another machine such as an envelope inserting machine where the folded piece 130 is inserted into an envelope for mailing, or a printer, or a labeler for putting on an address label, etc.

Figure 3A:
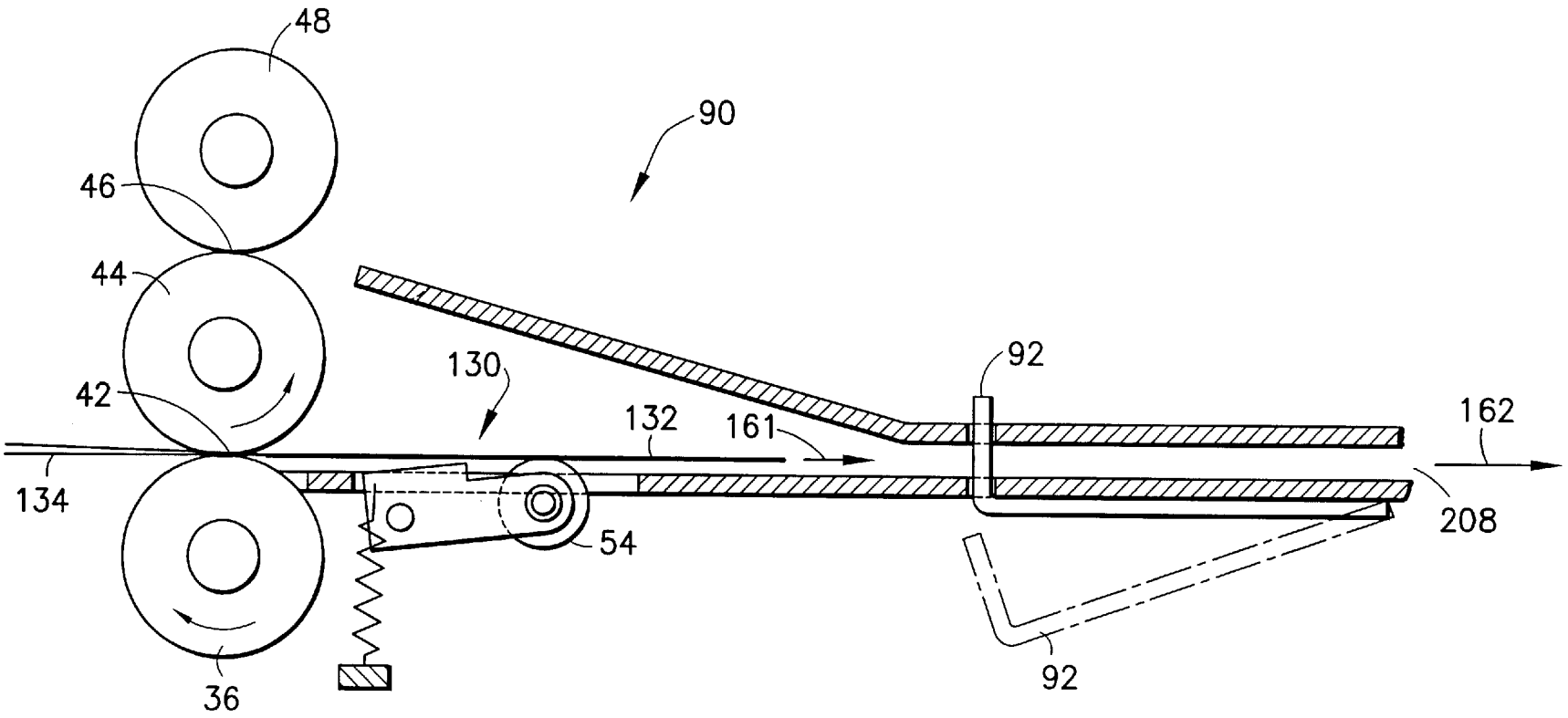
FIG. 3A and FIG. 3B are diagrammatic representations that illustrate the operating principle of the turn chute.
Figure 3B:
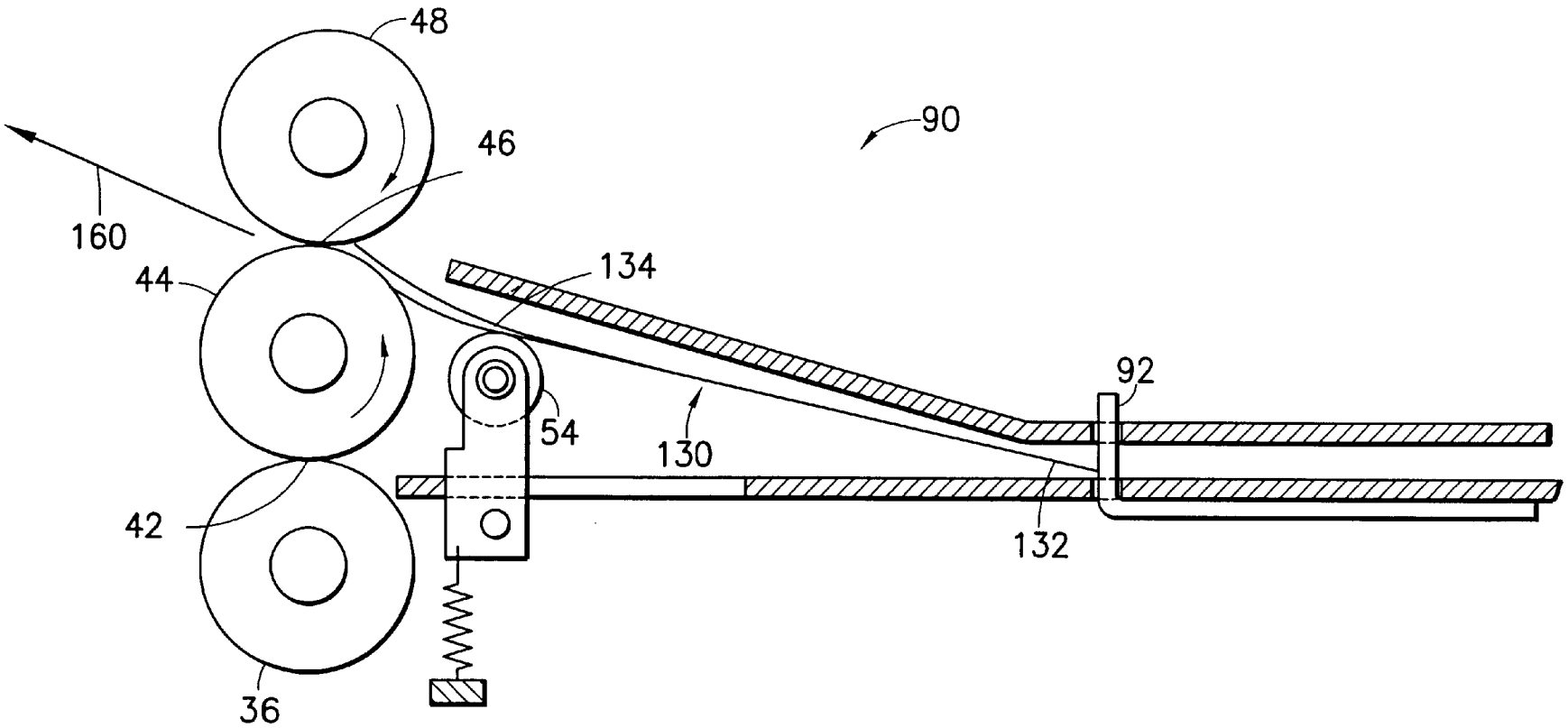

FIGS. 3A and 3B diagrammatically illustrate the operating principle of the turn chute 90. As shown in FIG. 3A, the folded material 130 is drawn into the turn chute 90 by an ingesting nip 42 formed by the rollers 36 and 44. Originally, the paper lift roller 54, which is spring-loaded, is at an upright position. As the leading edge 132 (the folded end) of the folded material 130 is moved into the turn chute 90, it depresses the paper lift roller 54 until the leading edge 132 is stopped by the turn chute stop 92 (shown diagrammatically). Even after the leading edge 132 of the folded piece 130 is stopped by the turn chute stop 92, the trailing edge 134 (the open end) of the folded piece 130 is still drawn into the turn chute 90 by the ingesting nip 42. Because the distance between the turn chute stop 92 and the ingesting nip 42 is slightly shorter than the length of the folded piece 130, the trailing edge 134 of the folded piece 130 starts to buckle and the paper lift roller 54 starts to move back to its original position. Once the trailing edge 134 of the folded piece 130 is disengaged from the ingesting nip 42, with the help of the rotating roller 44 and the urging force of the returning paper lift roller 54, the open end 134 of the folded piece 130 is raised and moved toward the roller 48. Because the distance between the turn chute stop 92 and the nip 46 formed by the rollers 44 and 48 is also slightly shorter than the length of the folded piece 130, the open end 134 of the folded piece 130 is caused to be engaged with the nip 46, as shown in FIG. 3B. Subsequently, the folded piece 130 is moved out of the turn chute 90 by the rollers 44 and 48, along the direction 160.

Preferably, the turn chute stop 92 is operable at a closed position and an open position (shown with phantom lines in FIG. 3A), so that when the turn chute stop 92 is operated at the open position, the folded piece 130 is allowed to move out of the turn chute 90 through the direct exit 208 along the direction 162 with the folded end 132 leading the open end 134.

Figure 4:
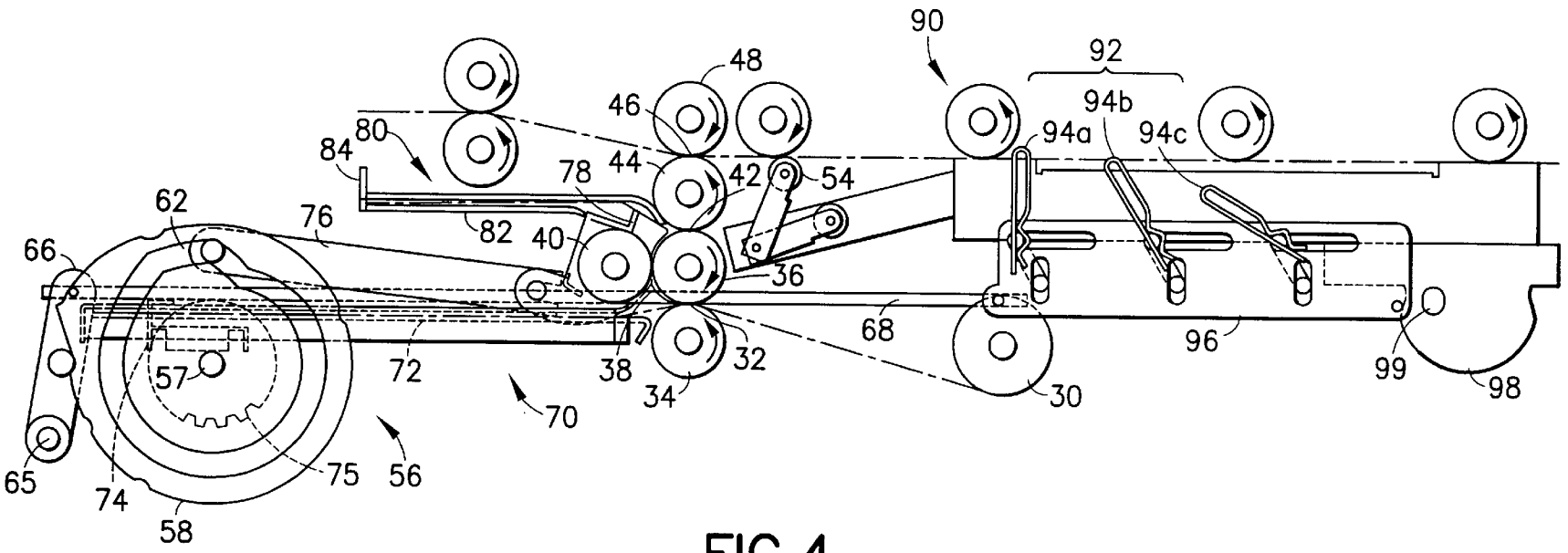
FIG. 4 is a schematic representation of the folding apparatus showing the relative position of the adjustable components of the folding apparatus when the folding apparatus is set up for making a Z-fold.

Now referring to FIG. 4, the first buckle chute 70 comprises a lower sheet guide 72, a sheet stop 74, and a first folding nip 38 formed by the rollers 36 and 40. The location of the sheet stop 74 is adjustable so as to accommodate the length of the sheet 120 and the desired fold type for the folded piece 130. Different fold types are illustrated in FIGS. 11–14. The second buckle chute 80 has an upper sheet guide 82, and a fold stop 84. The turn chute stop 92 in the turn chute 90 comprises a plurality of reversing stops 94*a*, 94*b* and 94*c*, mounted on a common stop actuator 96. In FIG. 4, there is shown a deflector gate 78 which can be operated at an open position and a closed position. When the deflector gate 78 is operated at the closed position, the sheet 120 folded by the first buckle chute 70 is directly ingested into the turn chute 90. When the deflector gate is operated at the open position, it allows the sheet 120 folded by the first buckle chute 70 to enter the second buckle chute 80 for making a second fold. As shown in FIG. 3, the deflector gate 78 is operated at the open position.

In the preferred embodiment as shown in FIGS. 4–10, the position of the sheet stop 74, the operating position of the deflector gate 78 and the turn chute stop 92 are controlled by a selector knob 56. The selector knob 56 can be manually or electro-mechanically turned about a rotating axis 57 to select the setting according to the fold type and the sheet length. As shown, an adjustment gear 75 is linked to the selector knob 56 for adjusting the position of the sheet stop 74. Also shown is a gate cam 62 linked to the selector knob 56 and a gate actuator 76 to control the operating position of the deflector gate 78. Furthermore, a control rod 68 is used to move the reversing stop actuator 96 in order to select the operating position of the reversing stops 94*a*–94*c* and to adjust the distance between the reversing stops 94*a*–94*c* and the ingesting nip 42. 65. The control rod 68 is pivotably mounted on a lever 66 which is mounted at pivot point The lever 66 is pushed outward from the selector knob 56 by a stop cam 58. The stop cam 58 and the gate cam 62 are fixedly mounted to the selector knob 56 so as to change the position of the deflector gate 78 and the reversing stops 94*a*–94*c* according to the position of the selector knob 56.

Figure 11:
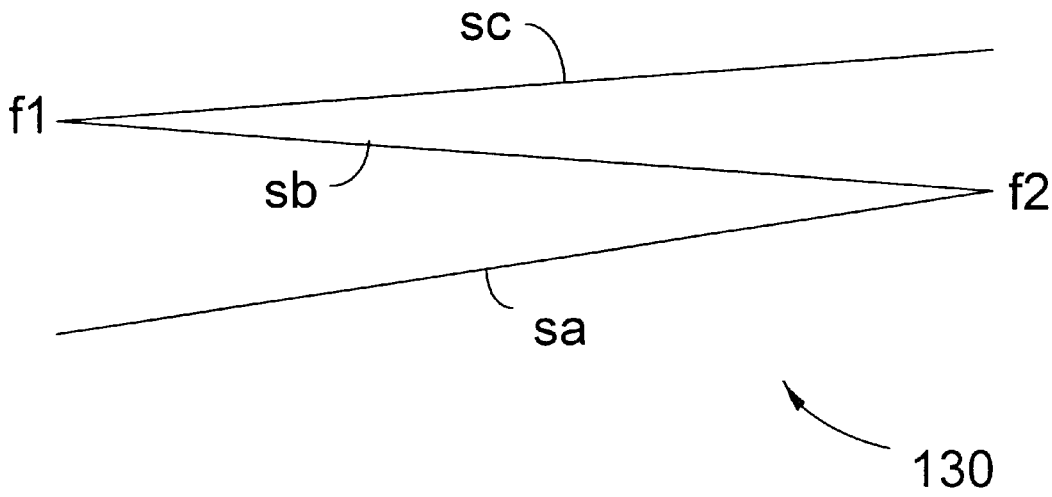
FIG. 11 is a schematic representation of a folded piece with a Z-fold.

As shown in FIG. 4, the selector knob 56 is set to a position for making a double-folded piece known as a Z-fold, as shown in FIG. 11. With the Z-fold setting, the deflector gate 78 is operated at the open position so as to allow the folded sheet exiting the first buckle chute 70 to enter the second buckle chute 80 so as to be folded a second time before the folded piece 130 is moved into the turn chute 90. As shown, the reversing stop 94*a* is used to stop the ingested folded piece 130 from exiting the turn chute 90 through the direct exit 208.

As shown in FIG. 11, a folded piece 130 with a Z-fold is folded twice into three connecting sections denoted by sa, sb and sc having two folded edges f1, f2. In the setting as shown in FIG. 4, the distance between the first folding nip 38 and the sheet stop 74 is substantially equal to sa+sb. When a sheet 120 is moved by the entrance nip 32 into the first buckle chute 70, it is stopped by the sheet stop 74. As the entrance nip 32 continues to move the trailing end of the sheet 120 into the turn chute 70, it causes the sheet 120 to buckle toward the first folding nip 38. When the buckled section of the sheet 120 becomes engaged with the first folding nip 38, the rollers 36 and 40 move the sheet 120 at the buckled point through the first folding nip 38 to make the first fold at the folded edge fi (see FIG. 11). The singly-folded sheet is moved further into the second buckle chute 80 in the direction of the folded edge f1 until the folded edge f1 is stopped by the fold stop 84. As the rollers 36 and 40 continue to move the singly-folded sheet into the second buckle chute 80, they cause the sheet 120 to buckle again and become engaged with the ingesting nip 42 of the turn chute 90. The distance between the fold stop 84 and the ingesting nip 42 of the turn chute 90 is set to be substantially equal to sb. Then, the singly-folded sheet is pulled through the ingesting nip 42 into the turn chute 90, making a second fold at the folded edge f2 (FIG. 11). When the twice-folded piece 130 is moved into the turn chute 90, it depresses the paper lift roller 54 so as to allow the entire folded piece 130 to enter the turn chute 90. The entered folded piece 130 is stopped by the reversing stop 94*a*. Because the distance between the reversing stop 94*a* and the ingesting nip 42 is slightly shorter than the length sb of the folded piece 130, the trailing end 134 of the folded piece 133 is caused to move toward the exiting nip 46. Subsequently, the exiting nip 46 moves the ingested folded piece 133 out of the turn chute 90. In the particular fold setting of FIG. 4, sb=sc=3.75" (95.25 mm) and sa=3.5" (88.9 mm) for a sheet 120 with a length of 11" (279.4 mm).

Figure 5:
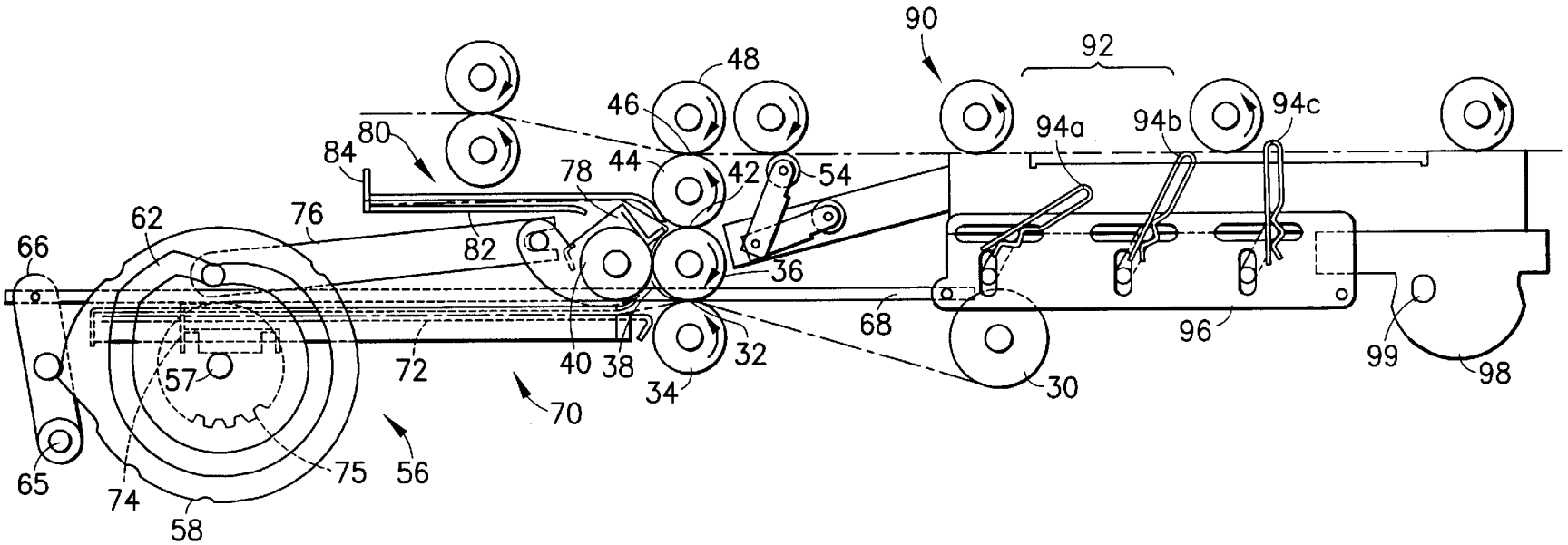
FIG. 5 is a schematic representation of the folding apparatus when the folding apparatus is set up for making a single fold from a sheet of document having a length of 14" (355.6 mm).
Figure 12:
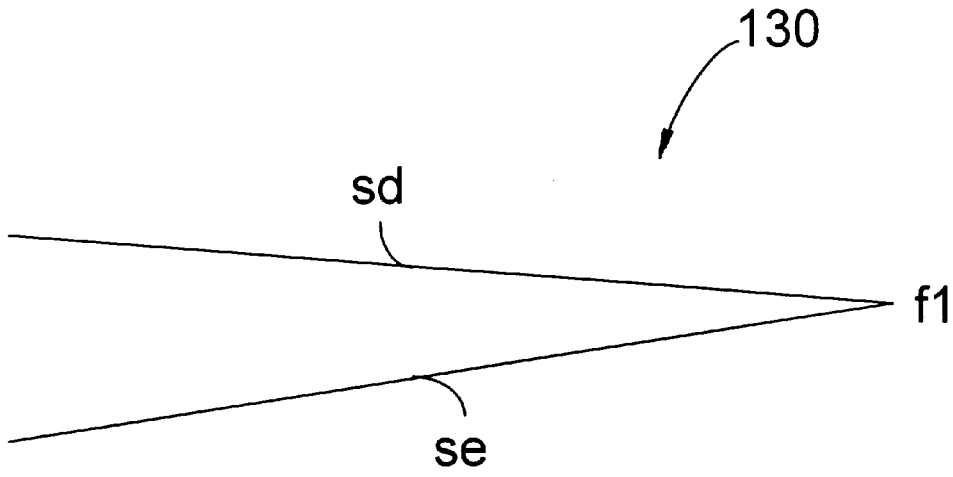
FIG. 12 is a schematic representation of a folded piece with a single-fold.

FIG. 5 shows the setting for making a folded piece with a single fold from a sheet having a length of 14" (355.6 mm). The folded output is a C-fold, as shown in FIG. 12, with fold length sd=se=7.0" (177.8 mm). As shown in FIG. 5, the selector knob 56 is now turned in the counter-clockwise direction from the position shown in FIG. 4. The distance between the sheet stop 74 and the first folding nip 38 is set substantially equal to sd. Because only one fold is required to fold a sheet 120 into a folded piece 130, the deflector gate 78 is now operated at the closed position so as to cause the folded sheet to be engaged with the ingesting nip 42 after the folded sheet exits the first folding nip 38. The reversing stop 94*c* is used to stop the ingested folded piece 130 from leaving the turn chute through the direct exit 208. The distance between the ingesting nip 42 and the reversing stop 94*c* is slightly less than sd.

Figure 6:
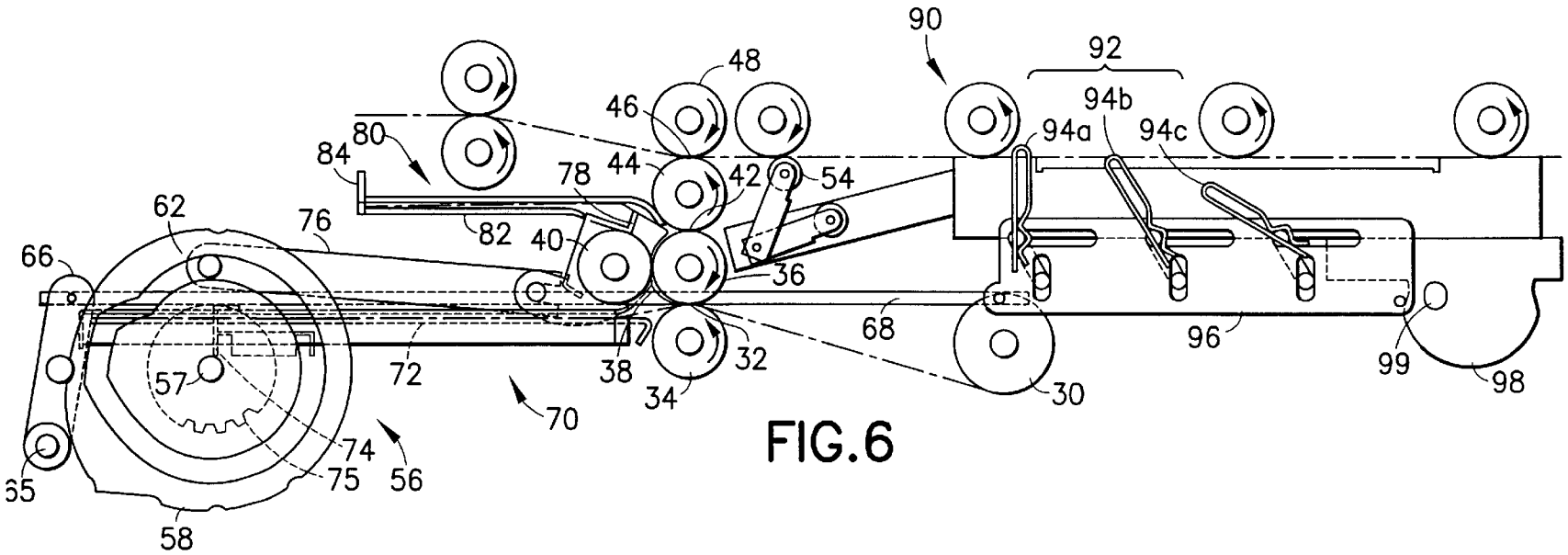
FIG. 6 is a schematic representation of the folding apparatus when the folding apparatus is set up for making a double fold.
Figure 13:
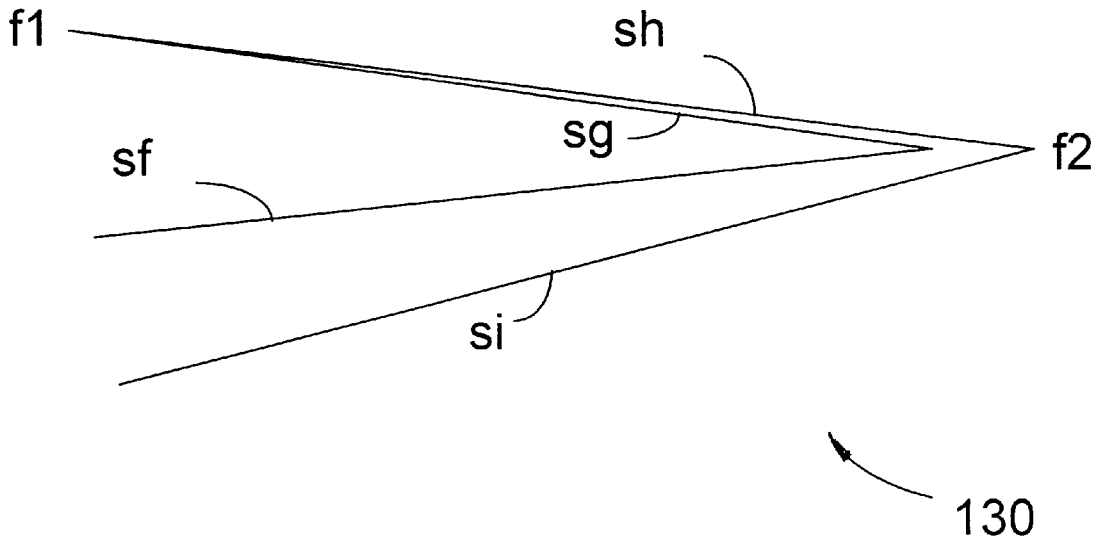
FIG. 13 is a schematic representation of a folded piece with a double-fold.

In FIG. 6, the setting is set for a double-fold as shown in FIG. 13, with the length of the folded section being sf=2.75" (69.85 mm), sg=sh=si=3.75" (95.25 mm). The selector knob is set at a different position from the setting as shown in FIG. 5. The distance between the sheet stop 74 and the first folding nip 38 is substantially equal to sf+sg to allow the first folding nip 38 to make the first fold between segments sg and sh. As with the setting for any folded piece that requires a second fold, the deflector gate 78 is operated at the open position so as to allow the folded sheet to enter the second buckle chute for making a second fold. The reversing stop 94*a* is again used to stop the folded piece 130 ingested into the turn chute.

Figure 7:
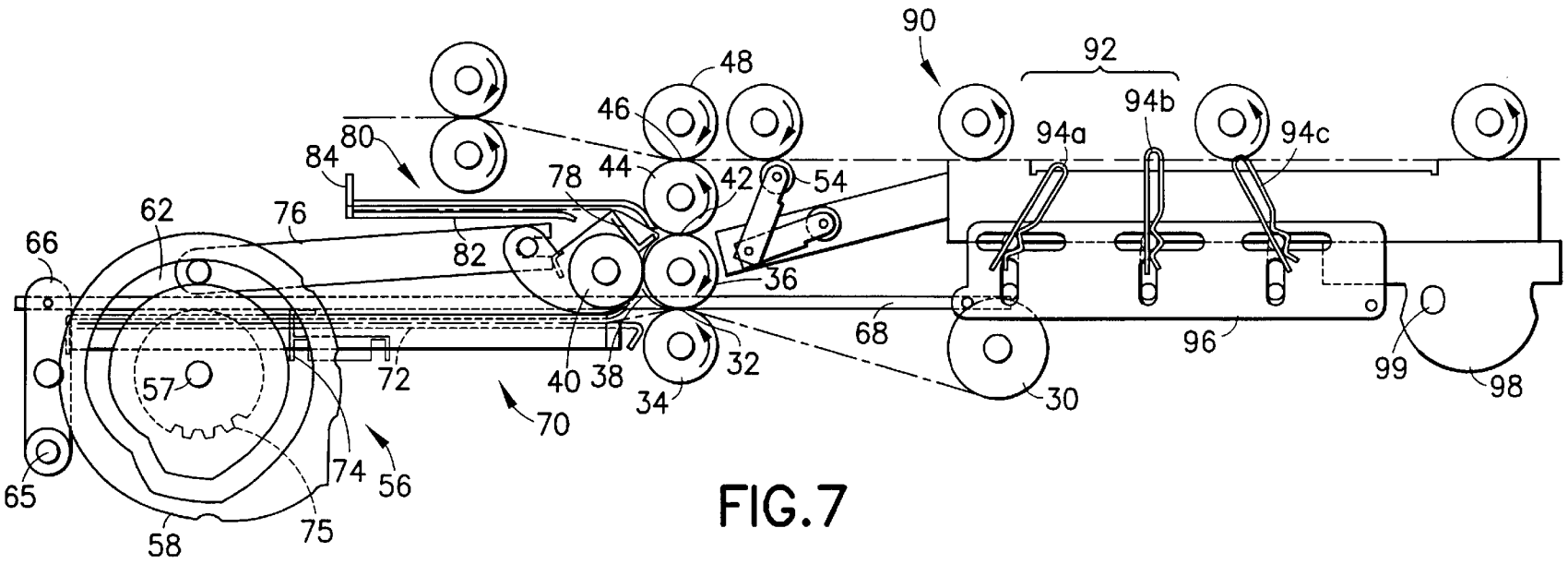
FIG. 7 is a schematic representation of the folding apparatus when the folding apparatus is set up for making a single fold from a sheet of document having a length of 11" (279.4 mm).

FIG. 7 shows the folding apparatus 10 in the setting for a single fold, similar to the setting shown in FIG. 5. The setting shown in FIG. 7 is for making a single fold from a sheet having a length of 11" (279.4 mm). Accordingly, the distance between the sheet stop 74 and the folding nip 38 is shortened to about 5.5" (139.7 mm). Furthermore, the reversing stop 94*b* is used to stop the ingested folded piece 130 in the turn chute 90. The distance between the reversing stop 94*b* and the ingesting nip 42 is slightly shorter than 5.5" (139.7 mm).

Figure 8:
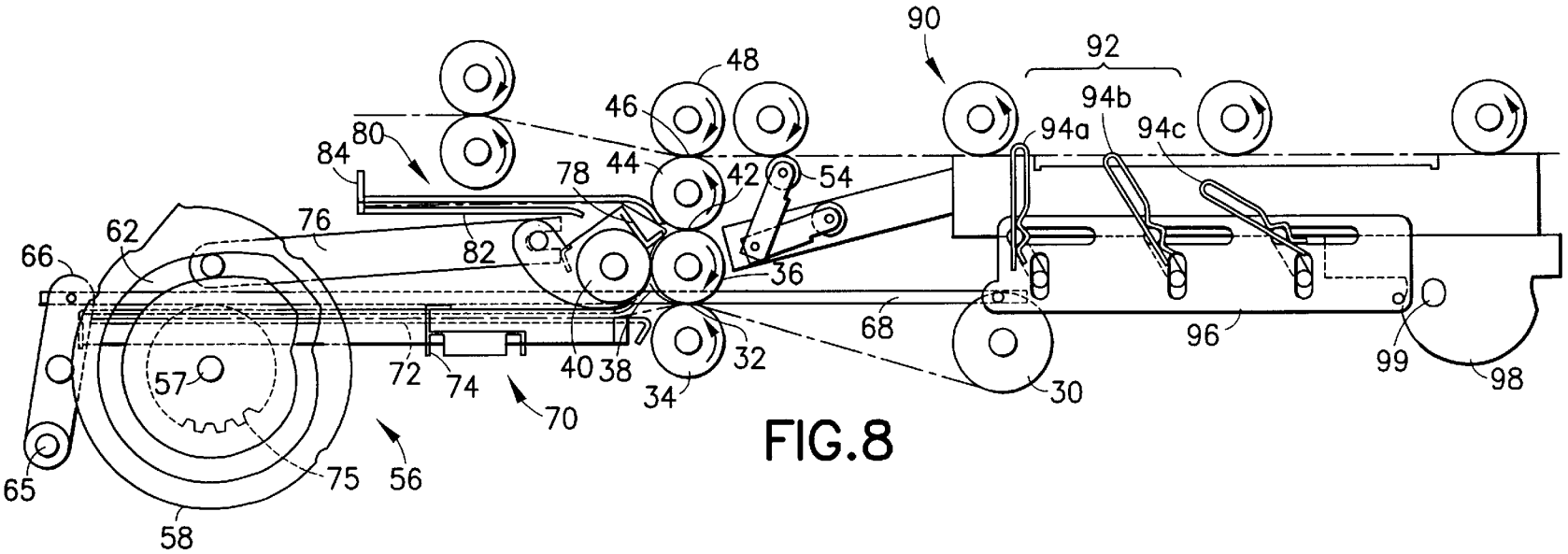
FIG. 8 is a schematic representation of the folding apparatus when the folding apparatus is set up for making a single fold from a sheet of document having a length of 8" (203.2 mm).

FIG. 8 shows another setting for a single fold, similar to FIGS. 5 and 7. The setting shown in FIG. 8 is for making a single fold from a sheet having a length of 8" (203.2 mm). Accordingly, the distance between the sheet stop 74 and the folding nip 38 is further shortened to about 4" (101.6 mm). Furthermore, the reversing stop 94*a* is used to stop the ingested folded piece 130 in the turn chute 90. The distance between the reversing stop 94*a* and the ingesting nip 42 is slightly shorter than 4" (101.6 mm).

Figure 9:
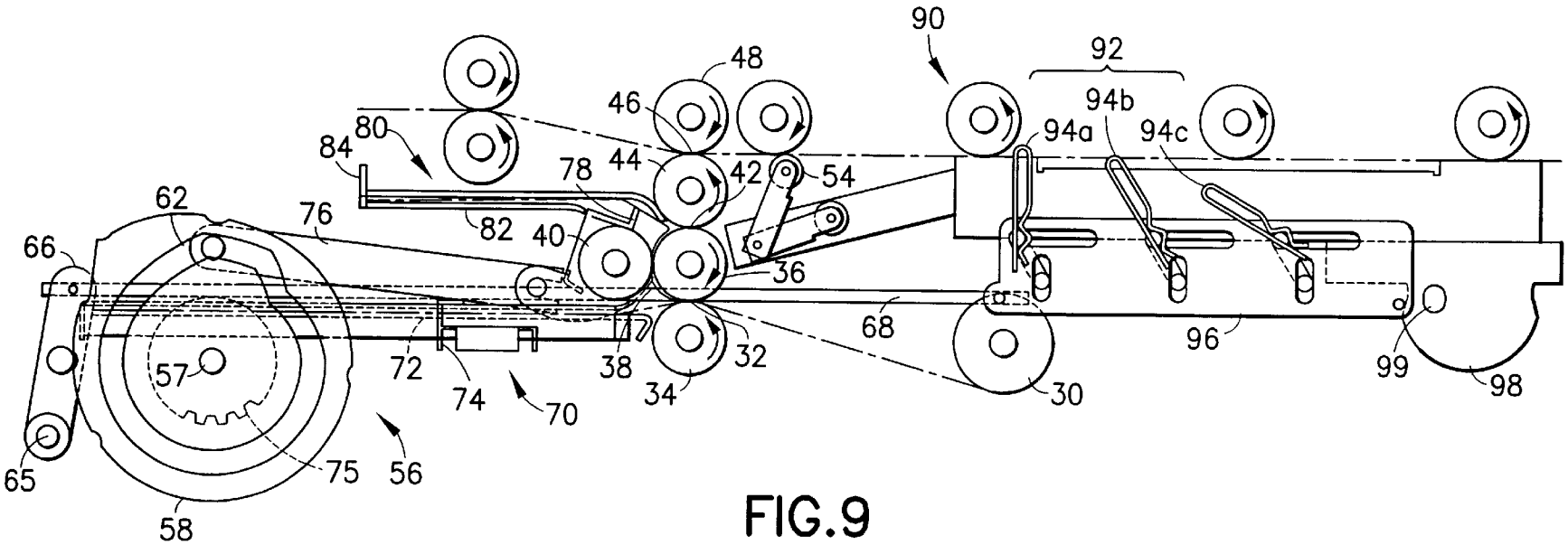
FIG. 9 is a schematic representation of the folding apparatus when the folding apparatus is set up for making a C-fold.
Figure 14:
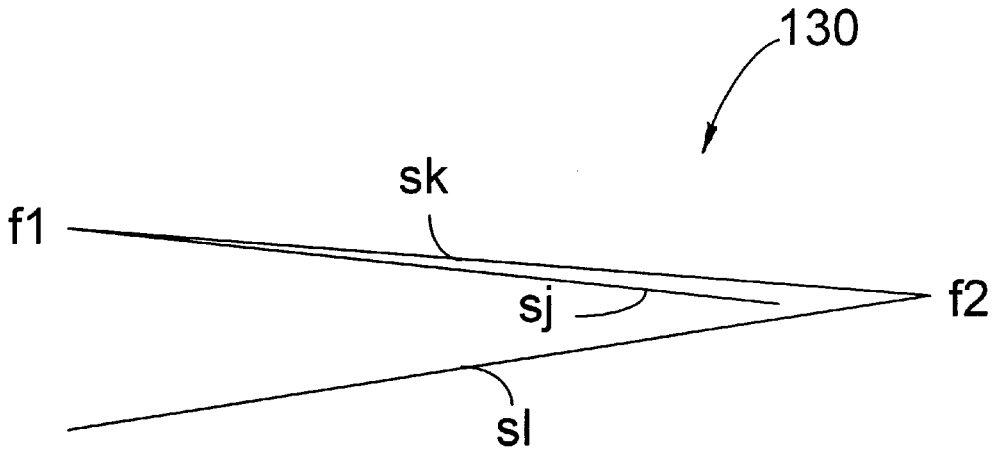
FIG. 14 is a schematic representation of a folded piece with a C-fold.

FIG. 9 shows the folding apparatus 10 in the setting for making a C-fold, as shown in FIG. 14. In particular, a sheet having a length of 11" (279.4 mm) is folded into three sections sj=sl=3.625" (92.075 mm), and sk=3.75" (95.25 mm). The setting in FIG. 8 is similar to the setting in FIG. 4, except that the distance between the sheet stop 74 and the folding nip 38 is shortened to 3.625" (92.075 mm), and the reversing stop 94*a* is used to stop the ingested folded piece 130 in the turn chute 90. The distance between the reversing stop 94*a* and the ingesting nip 42 is shortened by the stop cam 58 to slightly less than 3.75" (95.25 mm).

Figure 10:
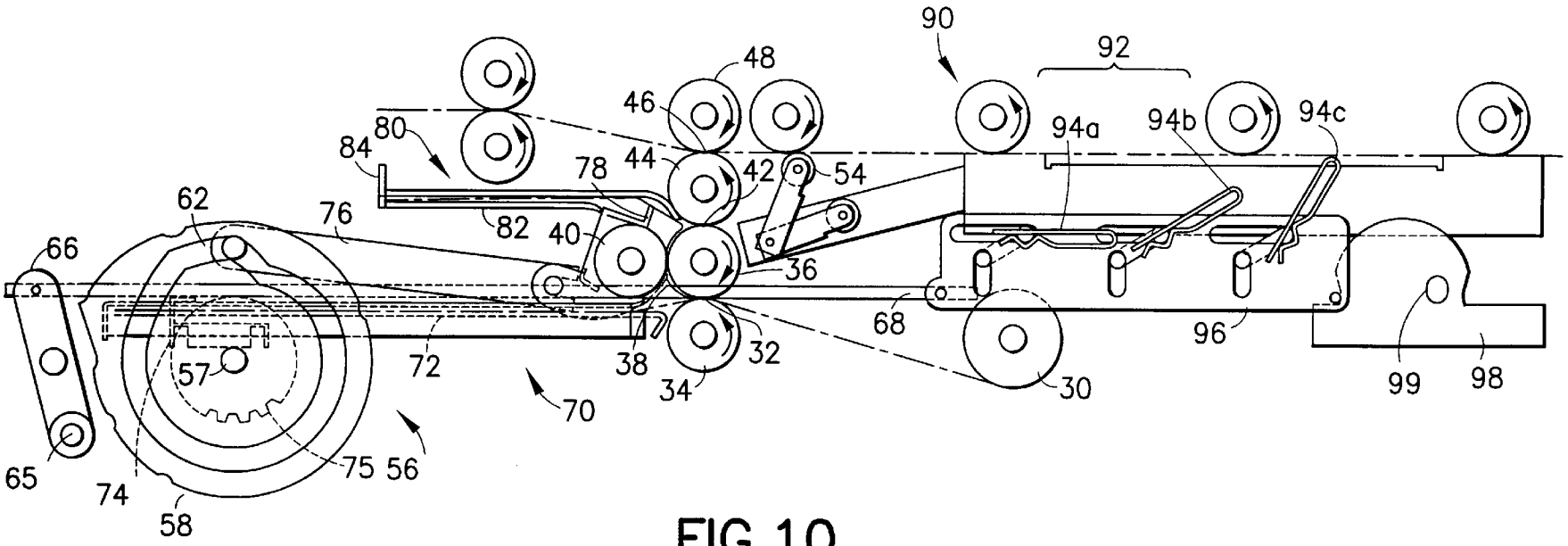
FIG. 10 is a schematic representation of the folding apparatus when the folding apparatus is set up for making a Z-fold but the folded piece is allowed to exit the folding apparatus in a different manner as compared to the setting shown in FIG. 4.

FIG. 10 shows that the folded piece 130 is allowed to exit the turn chute 90 through the direct exit 208. As shown, a direct exit cam 98 which is rotatably mounted at pivot point 99 is used to push the reversing stop actuator 96 towards the ingesting nip 42, disengaging the lever 66 from the stop cam 58, and causing all the reversing stops 94*a*–94*c* to move out of the path 162 of the ingested folded piece 130. As described in conjunction with FIG. 3A above, when an ingested folded piece 130 exits the turn chute 90 through the direct exit 28, its leading edge is the same edge as that when it is ingested into the turn chute 90.

It should be noted that the orientation of the direct exit 98 is not linked to the position of the selector knob 56. A folded piece of any fold type can be allowed to exit the turn chute 90 through the direct exit 208 if so desired.

Although the invention has been described with respect to the preferred embodiments thereof, it will be understood by those skilled in the art that the foregoing and various other changes, omissions and deviations in the form and detail thereof may be made without departing from the spirit and scope of this invention.

What is claimed is:

1. An apparatus for folding a sheet having a length into a folded piece of a fold type having a first edge and an opposing second edge, said apparatus comprising:

(a) a folding station for folding the sheet into the folded piece, the folding station further comprising
  (i) a buckle chute for receiving the sheet entering the folding station:
  (ii) a folding nip; and
  (iii) a sheet stop for stopping the sheet which is fed into the buckle chute thereby causing the sheet to buckle toward the folding nip and to be folded by the folding nip into the folded piece;

(b) a feeding mechanism to feed the sheet into the folding station in order to fold the sheet into the folded piece;

(c) a turn chute having
  (i) an ingesting mechanism to ingest the folded piece into the turn chute with the first edge leading the second edge;
  (ii) a reversing stop to stop the ingested folded piece; and
  (iii) a moving mechanism to move the ingested folded piece out of the turn chute with the second edge leading the first edge and (d) wherein the sheet stop in the folding station and the reversing stop in the turn chute are adjustable to suit the fold type and the sheet length, and the apparatus further comprises a selecting mechanism connected to the folding station and the turn chute so as to simultaneously adjust the sheet stop and the reversing stop.

2. The apparatus of claim 1, wherein the turn chute further comprises a first exit and a second exit, each dimensioned for passage of the folded piece, wherein the reversing stop is operable at a first position and a second position, and wherein when the reversing stop is operated at the first position, the reversing stop causes the ingested folded piece to be engaged with the moving mechanism in order to move the folded piece through the first exit with the second edge leading the first edge, and when the reversing stop is operated at the second position, the ingested folded piece is allowed to exit through the second exit with the first edge leading the second edge.

3. The apparatus of claim 1, wherein the folding station comprises:

(a) a first buckle chute for folding the sheet which is fed into the folding station into a folded sheet;

(b) a second buckle chute; and (c) a deflector gate operable at a first gate position and a second gate position, wherein when the deflector gate is operated at the first gate position, the folded sheet is the folded piece and the deflector gate causes the folded piece to be ingested into the turn chute directly from the first buckle chute, and when the deflector gate is operated at the second gate position, the deflector gate allows the folded sheet to enter the second buckle chute to be folded again into the folded piece.

4. The apparatus of claim 3, wherein the turn chute further comprises a first exit and a second exit, each dimensioned for passage of the folded piece, wherein the reversing stop is operable at a first position and a second position, and wherein when the reversing stop is operated at the first position, the reversing stop causes the ingested folded piece to be engaged with the moving mechanism in order to move the folded piece through the first exit with the second edge leading the first edge, and when the reversing stop is operated at the second position, the ingested folded piece is allowed to exit the second exit with the first edge leading the second edge.

5. The apparatus of claim 3, wherein the first buckle chute comprises:

(a) a folding nip; and (b) a sheet stop for stopping the sheet fed into the folding station, thereby causing said sheet to buckle toward the folding nip and to be folded by the folding nip into the folded sheet.

6. The apparatus of claim 5, wherein the sheet stop in the first buckle chute and the reversing stop in the turn chute are adjustable to suit the fold type and the sheet length, and the apparatus further comprises a selecting mechanism connected to the folding station and the turn chute so as to simultaneously adjust the sheet stop and the reversing stop and select the operating position of the deflector gate.

7. The apparatus of claim 6, wherein the sheet stop comprises a plurality of individual stops each located at a different distance from the ingesting mechanism to suit a fold type and/or a sheet length, wherein the individual stops are selectable by the selecting mechanism.

8. The apparatus of claim 6, wherein the apparatus has a plurality of settings for selecting the fold type and the sheet length, the selecting mechanism comprising:

(a) a turn knob rotatably mounted about an axis for selecting one setting at a time;

(b) a gear linking the turn knob to the sheet stop for adjusting the sheet stop;

(c) a first cam connected to the turn knob and a first link for engaging the deflector gate to the first cam in order to select the operating position of the deflector gate; and (d) a second cam connected to the turn knob and a second link for engaging the reversing stop to the second cam in order to adjust the reversing stop.

9. The apparatus of claim 1, wherein the turn chute further comprises a paper lift roller located inside the turn chute adjacent to the ingesting mechanism so that when the folded piece is ingested by the ingesting mechanism, the paper lift roller is depressed to allow the folded sheet to move into the turn chute, and when the folded sheet is stopped by the reversing stop, the paper lift roller urges the second edge of the folded piece to move towards the moving mechanism so as to allow the moving mechanism to move the ingested folded piece out of the turn chute.

10. The apparatus of claim 1, wherein the ingesting mechanism comprises a nip formed by a pair of rollers.

11. The apparatus of claim 1, wherein the moving mechanism comprises a nip formed by a pair of rollers.

12. The apparatus of claim 1 further comprising a sheet supply located adjacent to the feeding mechanism to provide one sheet at a time to the folding station.

13. The apparatus of claim 1, wherein the feeding mechanism comprises a feed roller.

14. A method of producing a folded piece of a fold type having a first edge and an opposing second edge, said method comprising the steps of:

(a) providing a sheet having a length;

(b) folding the sheet into the folded piece which moves in a direction with the first edge leading the second edge after the sheet is folded and wherein:

(i) the folded piece has a folded length and wherein the fold type and the folded length are essentially simultaneously selectable; and (ii) wherein the folding step is carried out in a buckle chute having means for selecting the fold type and the sheet length; and (c) controlling the moving direction of the folded piece so as to allow the folded piece to move with the first edge leading or trailing the second edge and wherein the controlling step is carried out in a turn chute having a reversing stop adjustable to suit the fold type and the sheet length, said method further comprising the step of simultaneously adjusting the selecting means and the reversing stop in order to suit the fold type and the sheet length.

15. The method of claim 14, wherein the controlling step is carried out in a turn chute comprising:

(a) an ingesting nip for ingesting the folded piece into the turn chute with the first edge leading the second edge; and (b) stopping means, operable at a first position and a second position, for causing the folded piece to be moved out of the turn chute with the first edge trailing the second edge when the stopping means is operated at the first position, and for allowing the folded piece to exit the turn chute with the first edge leading the second edge when the stopping means is operated at the second position.

* * * * *